US010704814B2

(12) United States Patent
De

(10) Patent No.: US 10,704,814 B2
(45) Date of Patent: Jul. 7, 2020

(54) EXPANSION VALVE CONTROL

(71) Applicant: Carrier Corporation, Farmington, CT (US)

(72) Inventor: Tathagata De, Charlotte, NC (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 145 days.

(21) Appl. No.: 15/556,933

(22) PCT Filed: Mar. 8, 2016

(86) PCT No.: PCT/US2016/021307
§ 371 (c)(1),
(2) Date: Sep. 8, 2017

(87) PCT Pub. No.: WO2016/144929
PCT Pub. Date: Sep. 15, 2016

(65) Prior Publication Data

US 2018/0066879 A1 Mar. 8, 2018

Related U.S. Application Data

(60) Provisional application No. 62/130,306, filed on Mar. 9, 2015.

(51) Int. Cl.
*F25B 41/06* (2006.01)
*F25B 49/02* (2006.01)

(52) U.S. Cl.
CPC ..... *F25B 41/062* (2013.01); *F25B 49/02* (2013.01); *F25B 2341/065* (2013.01);
(Continued)

(58) Field of Classification Search
CPC ..... F25B 2341/065; F25B 2500/18; F25B 2500/26; F25B 2600/2513;
(Continued)

(56) References Cited

U.S. PATENT DOCUMENTS 3,735,603 A * 5/1973 Hamilton ..... F25B 41/062 62/210
5,561,599 A 10/1996 Lu
(Continued)

FOREIGN PATENT DOCUMENTS

CN 1477355 A 2/2004
CN 1811306 A 8/2006
(Continued)

OTHER PUBLICATIONS

International Search Report and Written Opinion for application PCT/US2016/021307, dated Jun. 3, 2016, 12pgs.
(Continued)

*Primary Examiner* — Edward F Landrum
*Assistant Examiner* — Chang H Park
(74) *Attorney, Agent, or Firm* — Cantor Colburn LLP

(57) ABSTRACT

A method for controlling a refrigeration system having a compressor, heat rejecting heat exchanger, expansion valve and heat absorbing heat exchanger circulating a refrigerant in series flow, the heat absorbing heat exchanger in thermal communication with working fluid, the method includes obtaining an expansion valve position set point; using a feedback control loop to generate a controlled expansion valve position; obtaining a rate of change of an operating parameter of the system; using the rate of change of the operating parameter to generate an adjustment; modifying the controlled expansion valve position using the adjustment; and controlling the expansion valve using the modified controlled expansion valve position.

8 Claims, 3 Drawing Sheets

(52) U.S. Cl.
CPC ..... *F25B 2500/18* (2013.01); *F25B 2500/26* (2013.01); *F25B 2600/2513* (2013.01); *F25B 2700/171* (2013.01); *F25B 2700/193* (2013.01); *F25B 2700/21* (2013.01); *F25B 2700/2115* (2013.01)

(58) Field of Classification Search
CPC ..... F25B 2700/171; F25B 2700/193; F25B 2700/21; F25B 2700/2115; F25B 41/062; F25B 49/02
See application file for complete search history.

(56) References Cited

U.S. PATENT DOCUMENTS

| | | | | |
|---|---|---|---|---|
| 5,632,154 | A * | 5/1997 | Sibik | F25B 41/062 165/292 |
| 5,809,794 | A | 9/1998 | Sibik et al. | |
| 5,809,795 | A * | 9/1998 | Beaverson | F25B 41/065 62/218 |
| 6,016,966 | A | 1/2000 | Inoue | |
| 6,035,651 | A | 3/2000 | Carey | |
| 6,266,964 | B1 | 7/2001 | Meyer et al. | |
| 6,357,242 | B1 | 3/2002 | Farley et al. | |
| 6,530,236 | B2 | 3/2003 | Crane et al. | |
| 6,854,285 | B2 | 2/2005 | Jessen | |
| 6,951,116 | B2 | 10/2005 | Lee et al. | |
| 7,290,402 | B1 | 11/2007 | Bailey | |
| 7,509,817 | B2 | 3/2009 | Hwang et al. | |
| 7,621,141 | B2 | 11/2009 | McCormick et al. | |
| 7,757,505 | B2 | 7/2010 | Sunderland | |
| 7,784,295 | B2 | 8/2010 | McCormick et al. | |
| 8,096,141 | B2 | 1/2012 | Vanderzee | |
| 8,151,583 | B2 | 4/2012 | Douglas | |
| 8,881,541 | B2 | 11/2014 | Noll et al. | |
| 8,887,518 | B2 | 11/2014 | Mercer et al. | |
| 2004/0068999 | A1 | 4/2004 | Jessen | |
| 2012/0260678 | A1 | 10/2012 | Yoshida | |
| 2012/0266623 | A1 | 10/2012 | Patel et al. | |
| 2013/0160474 | A1 | 6/2013 | Qu et al. | |
| 2013/0180272 | A1 | 7/2013 | Ono et al. | |
| 2013/0340452 | A1 | 12/2013 | Kleman et al. | |
| 2014/0137573 | A1 | 5/2014 | Lin et al. | |
| 2015/0068231 | A1 | 3/2015 | Rite et al. | |

FOREIGN PATENT DOCUMENTS

| | | | | |
|---|---|---|---|---|
| CN | 101228399 | A | 7/2008 | |
| CN | 102374714 | A | 3/2012 | |
| DE | 69515912 | T2 | 8/2000 | |
| EP | 2532992 | A1 | 12/2012 | |
| WO | 2008008337 | A2 | 1/2008 | |
| WO | 2012027241 | A1 | 3/2012 | |
| WO | WO-2012027241 | A1 * | 3/2012 | F25B 49/02 |
| WO | 2014102940 | A1 | 7/2014 | |
| WO | 2015006952 | A1 | 1/2015 | |

OTHER PUBLICATIONS

Chinese First Office Action for application 201680014522.4, dated Jun. 24, 2019, 7 pages.

* cited by examiner

EXPANSION VALVE CONTROL

BACKGROUND OF THE INVENTION

The subject matter disclosed herein relates generally to controlling an expansion valve, and more particularly to controlling an expansion valve using an anticipatory process to accommodate fast load changes in a refrigeration system.

Expansion valves, such as electronic expansion valves (EXVs) are used for metering refrigerant flow to an evaporator. The valves are typically slow moving and unable to keep up with fast loading (at startup or during rapid load change). Existing control methods may pre-open the expansion valve by a fixed number steps (or few discrete # of steps—e.g 50% and 100%). However, this may cause a low suction pressure fault (if the # of steps are too small compared to loading rate) or may cause compressor flooding (if the # of steps are too large compared to loading rate). Existing control methods do not employ provisions for pre-closing the valve, in case of load reduction, which exposes the chiller to potential compressor flooding.

BRIEF DESCRIPTION OF THE INVENTION

According to an aspect of the invention, a method for controlling a refrigeration system having a compressor, heat rejecting heat exchanger, expansion valve and heat absorbing heat exchanger circulating a refrigerant in series flow, the heat absorbing heat exchanger in thermal communication with working fluid, the method includes obtaining an expansion valve position set point; using a feedback control loop to generate a controlled expansion valve position; obtaining a rate of change of an operating parameter of the system; using the rate of change of the operating parameter to generate an adjustment; modifying the controlled expansion valve position using the adjustment; and controlling the expansion valve using the modified controlled expansion valve position.

In addition to one or more of the features described above or below, or as an alternative, further embodiments could include wherein the operating parameter comprises motor speed of the compressor.

In addition to one or more of the features described above or below, or as an alternative, further embodiments could include wherein the operating parameter comprises temperature of the working fluid entering the heat absorbing heat exchanger.

In addition to one or more of the features described above or below, or as an alternative, further embodiments could include wherein the operating parameter comprises a variable indexing value for the compressor.

In addition to one or more of the features described above or below, or as an alternative, further embodiments could include wherein the operating parameter comprises liquid level in the heat rejecting heat exchanger.

According to an aspect of the invention a refrigeration system includes a compressor; a heat rejecting heat exchanger; an expansion valve; a heat absorbing heat exchanger in thermal communication with working fluid; a controller to control the expansion valve, the controller performing operations comprising: obtaining an expansion valve position set point; using a feedback control loop to generate a controlled expansion valve position; obtaining a rate of change of an operating parameter of the system; using the rate of change of the operating parameter to generate an adjustment; modifying the controlled expansion valve position using the adjustment and controlling the expansion valve using the modified controlled expansion valve position.

In addition to one or more of the features described above or below, or as an alternative, further embodiments could include wherein the operating parameter comprises motor speed of the compressor.

In addition to one or more of the features described above or below, or as an alternative, further embodiments could include wherein the operating parameter comprises temperature of the working fluid entering the heat absorbing heat exchanger.

In addition to one or more of the features described above or below, or as an alternative, further embodiments could include wherein the operating parameter comprises a variable indexing value for the compressor.

In addition to one or more of the features described above or below, or as an alternative, further embodiments could include wherein the operating parameter comprises liquid level in condenser.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
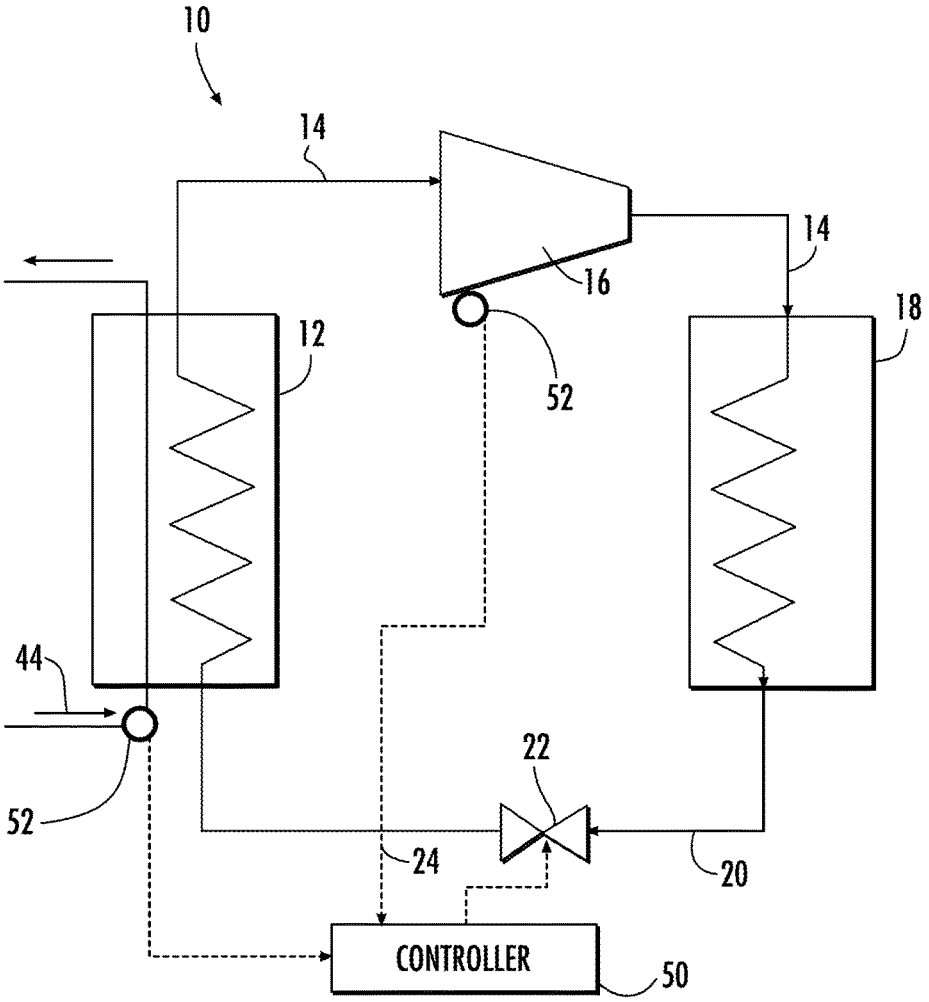
FIG. 1 is a schematic view of a heating, ventilation and air conditioning system in an exemplary embodiment.

FIG. 1 is a schematic view of an embodiment of a heating, ventilation and air conditioning (HVAC) unit, for example, a chiller 10. A compressor 16 receives vapor refrigerant 14 supplies refrigerant 14 to a heat rejecting heat exchanger 18 (e.g., condenser or gas cooler). Heat rejecting heat exchanger 18 outputs a flow of liquid refrigerant 20 to an expansion valve 22. The expansion valve 22 outputs a vapor and liquid refrigerant mixture 24 toward the heat absorbing heat exchanger 12 (e.g., evaporator). The heat absorbing heat exchanger 12 places the refrigerant in thermal communication with a working fluid 44 (e.g., air, brine, water, etc.), causing the refrigerant to assume a vapor state, while cooling the working fluid 44.

A controller 50 is coupled to the expansion valve 22 and controls the position of the expansion valve 22 using an adaptive process. Controller 50 may be implemented using known processor-based devices. Controller 50 receives sensor signals from one or more sensors 52. Sensors 52 may sense a variety of operational parameters of the system 10. Examples of such sensors include thermistors, pressure transducers, RTDs, liquid level sensors, speed sensors, etc. Sensors 52 can monitor a variety of parameters, directly or indirectly, including but not limited to: discharge pressure, discharge and suction superheat, subcooling, condenser and cooler refrigerant level, compressor speed, etc.

Figure 2:
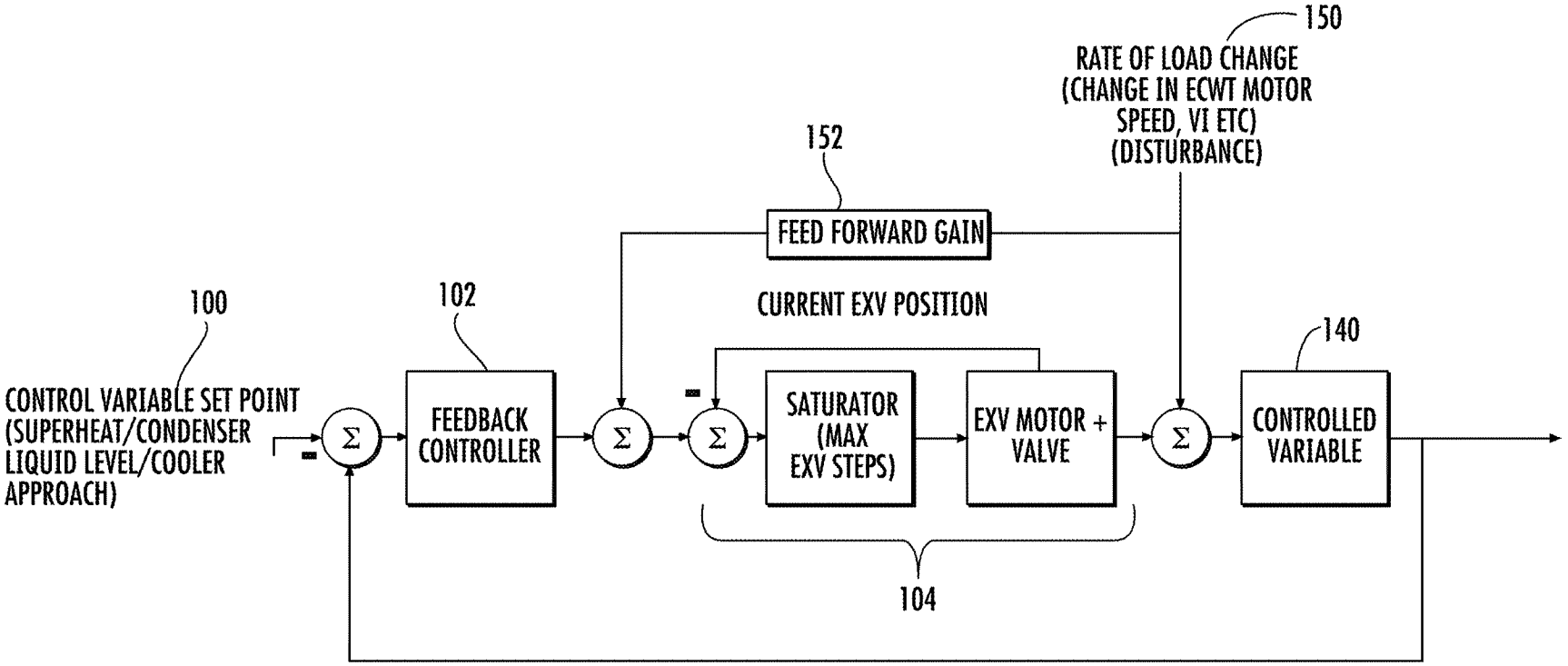
FIG. 2 depicts a control process for controlling position of an expansion valve in an exemplary embodiment.

FIG. 2 depicts a control process for controlling position of an expansion valve in an exemplary embodiment. The control process of FIG. 2 may be implemented by controller 50 to control the position of expansion valve 22 in an anticipatory manner. The controller 50 obtains a control variable (e.g., expansion valve position) set point 100 generated based on a first control loop. The expansion valve position set point 100 provides a desired opening for the expansion valve based on current conditions of system 10 (e.g., superheat, condenser liquid level, etc.). A feedback controller 102 receives a difference between expansion valve position set point 100 and the current controlled expansion valve position from output 140 and generates a controlled expansion valve position. The controlled expansion valve position may be limited by section 104, which may alter the controlled expansion valve position based on factors such as limits on the physical valve and current position of the valve. The controlled expansion valve position is then used by output 140 to generate the controlled expansion valve position to the expansion valve 22.

The control process of FIG. 2 also uses an anticipatory loop to adjust the controlled expansion valve position based on a rate of change of an operational parameter of the system. As shown in FIG. 2, a rate of change of an operational parameter of the system is obtained at 150. The operational parameters may relate to load on the system 10 or capacity of system 10. The operational parameter(s) may be one or more factors, such as change in temperature of working fluid 44 entering the heat absorbing heat exchanger 12, motor speed of compressor 16, a variable index value for compressor 16, liquid level in the heat rejecting heat exchanger 18, etc. These values may be provided by sensors 52 to controller 50, which computes the rate of change of the operational parameter. The rate of change of the operational parameter is used by a feed forward controller 152 to generate an adjustment used to modify the controlled expansion valve position. The adjustment to the controlled expansion valve position can be positive or negative (or zero). The adjustment to the controlled expansion valve position compensates to rapid changes in operating parameters of the system 10.

Figure 3:
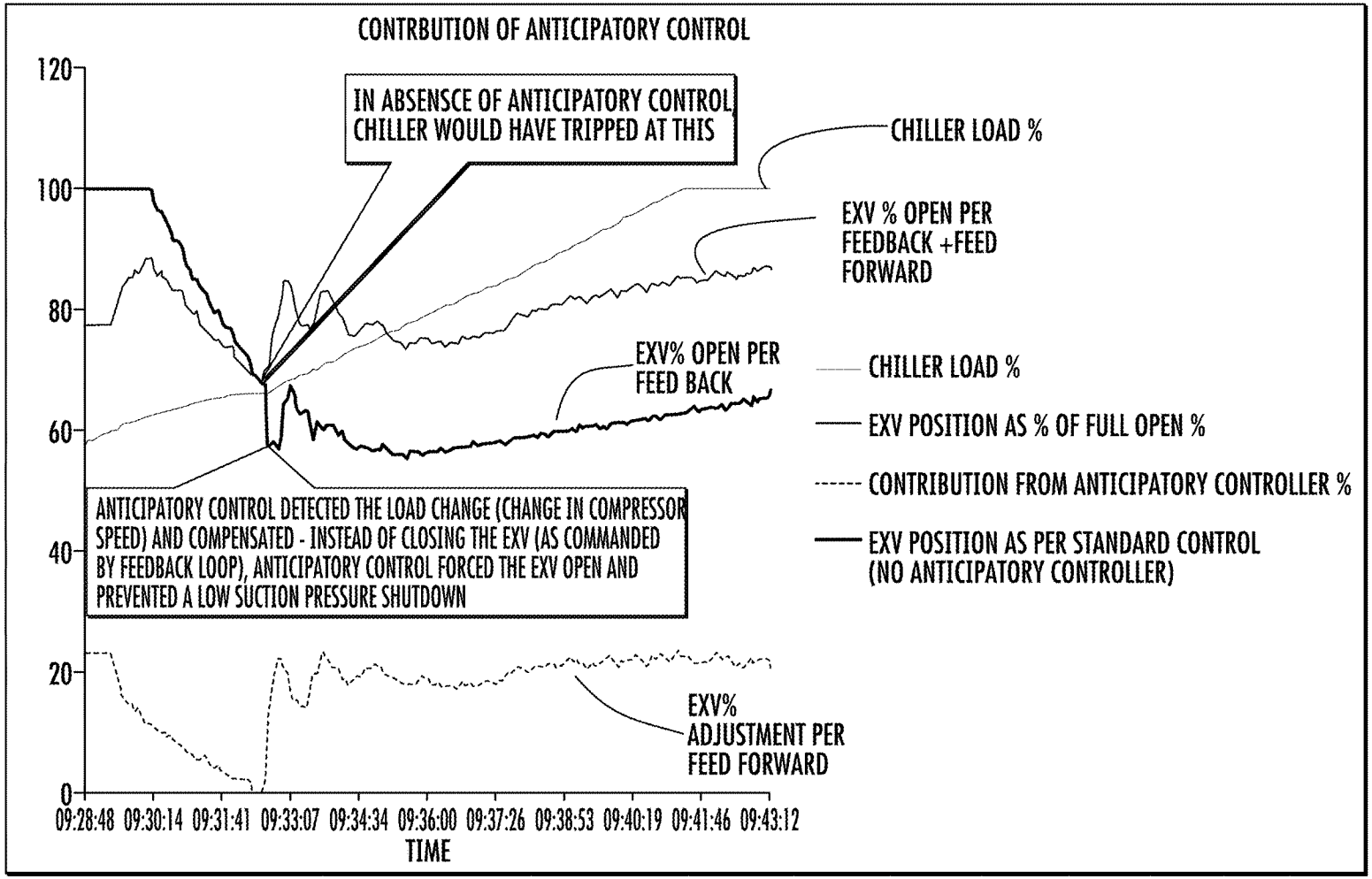
FIG. 3 depicts plots of expansion valve position and chiller load versus time in an exemplary embodiment.

FIG. 3 depicts plots of expansion valve position and chiller load versus time in an exemplary embodiment. As shown in FIG. 3, the combination of the feedback control and anticipatory feed forward control allows the expansion valve opening to increase upon anticipating an increased load. The feedback control alone would not anticipate the load change on the compressor and would result in a low suction pressure shutdown. By anticipating the load increase, the feed forward control generates an adjustment that increases the expansion valve opening, and accommodates the increased compressor speed. On the other hand, when the compressor speed falls rapidly in response to a reduction of fluid flow or reduction in load, the feedback controller 102 will not be able to anticipate the load change. It will cause the EXV to remain open and that will cause liquid carryover and low discharge superheat. Both of these are detrimental to compressor reliability. By anticipating the load decrease, the feed forward control 152 generates an adjustment that decreases the expansion valve opening, and accommodates the decreased compressor speed.

Embodiments provide a number of benefits including, but not limited to, (1) allowing the chiller to load and unload quickly (2) avoiding nuisance trips during fast loading (3) improved reliability by reducing chance of compressor flooding and loss of liquid seal and (4) improving settling time (time to reach steady state) of the chiller because the pre-open/pre-close value used is proportional to actual load change. In some embodiments, the anticipatory control is active only when it is necessary (during a change of load or other system parameter(s)). The anticipatory control is activated (turned on) when the magnitude of the rate of change of an operating parameter(s) and the load exceeds a certain threshold and it is de-activated when the magnitude of the rate of change of operating parameter(s) and the load falls below a certain threshold. It is understood that the anticipatory control may be active at all times, or activated based on other conditions.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed for carrying out this invention, but that the invention will include all embodiments falling within the scope of the claims. Moreover, the use of the terms first, second, etc., do not denote any order or importance, but rather the terms first, second, etc., are used to distinguish one element from another. Furthermore, the use of the terms a, an, etc., do not denote a limitation of quantity, but rather denote the presence of at least one of the referenced item.

The invention claimed is:

1. A method for controlling a refrigeration system having a compressor, a heat rejecting heat exchanger, an expansion valve and a heat absorbing heat exchanger circulating a refrigerant in series flow, the heat absorbing heat exchanger in thermal communication with working fluid, the method comprising:

obtaining an expansion valve position set point;

obtaining a rate of change of an operating parameter of the system;

receiving a feed back current controlled expansion valve position;

determining a difference between the expansion valve position set point and the current controlled expansion valve position from output;

generating a controlled expansion valve position in response to the difference between the expansion valve position set point and the current controlled expansion valve position from output;

applying a feed forward gain to the controlled expansion valve position, the feed forward gain determined in response to the rate of change of an operating parameter of the system;

limiting the controlled expansion valve position;

using the rate of change of the operating parameter of the system to generate an adjustment;

modifying the controlled expansion valve position using the adjustment; and controlling the expansion valve using the modified controlled expansion valve position;

wherein the operating parameter comprises motor speed of the compressor.

2. The method of claim 1 wherein:

the operating parameter comprises temperature of the working fluid entering the heat absorbing heat exchanger.

3. The method of claim 1 wherein:

the operating parameter comprises a variable indexing value for the compressor.

4. The method of claim 1 wherein:

the operating parameter comprises liquid level in the heat rejecting heat exchanger.

5. A refrigeration system comprising:

a compressor;

a heat rejecting heat exchanger;

an expansion valve;

a heat absorbing heat exchanger in thermal communication with working fluid;

a controller to control the expansion valve, the controller performing operations comprising:

obtaining an expansion valve position set point;

obtaining a rate of change of an operating parameter of the system;

receiving a feed back current controlled expansion valve position;

determining a difference between the expansion valve position set point and the current controlled expansion valve position from output;

generating a controlled expansion valve position in response to the difference between the expansion valve position set point and the current controlled expansion valve position from output;

applying a feed forward gain to the controlled expansion valve position, the feed forward gain determined in response to the rate of change of an operating parameter of the system;

limiting the controlled expansion valve position;

using the rate of change of the operating parameter of the system to generate an adjustment;

modifying the controlled expansion valve position using the adjustment; and controlling the expansion valve using the modified controlled expansion valve position;

wherein the operating parameter comprises motor speed of the compressor.

6. The system of claim 5 wherein:

the operating parameter comprises temperature of the working fluid entering the heat absorbing heat exchanger.

7. The system of claim 5 wherein:

the operating parameter comprises a variable indexing value for the compressor.

8. The system of claim 5 wherein:

the operating parameter comprises liquid level in the heat rejecting heat exchanger.

* * * * *